US008848870B2

(12) United States Patent
Bruegemann et al.

(10) Patent No.: US 8,848,870 B2
(45) Date of Patent: Sep. 30, 2014

(54) POINT-LINE CONVERTER

(75) Inventors: Lutz Bruegemann, Durmersheim (DE); Carsten Michaelsen, Geesthacht (DE); Keisuke Saito, Yokohama (JP)

(73) Assignee: Bruker AXS GmbH, Karlsruhe (DE)

( * ) Notice: Subject to any disclaimer, the term of this patent is extended or adjusted under 35 U.S.C. 154(b) by 391 days.

(21) Appl. No.: 13/373,644

(22) Filed: Nov. 23, 2011

(65) Prior Publication Data

US 2012/0140897 A1 Jun. 7, 2012

(30) Foreign Application Priority Data

Dec. 6, 2010 (DE) ..... 10 2010 062 472

(51) Int. Cl.
*G21K 1/06* (2006.01)

(52) U.S. Cl.
CPC ..... *G21K 1/06* (2013.01); *G21K 2201/064* (2013.01)
USPC ..... 378/84; 378/85

(58) Field of Classification Search
CPC ..... G01N 23/223; G01N 23/20; G01N 23/04; G01N 23/207; G01N 23/046; G01N 21/47; G01N 23/201
USPC ..... 378/84, 85
See application file for complete search history.

(56) References Cited

U.S. PATENT DOCUMENTS 6,226,349 B1 5/2001 Schuster et al.
6,282,259 B1 * 8/2001 Crane ..... 378/84
2003/0108153 A1 6/2003 Lange et al.
2003/0112923 A1 6/2003 Lange et al.
2004/0019081 A1 1/2004 Crooks
2004/0066894 A1 4/2004 Holz et al.
2004/0136102 A1 7/2004 Cho
2004/0228440 A1 11/2004 Vigliante
2007/0236815 A1 10/2007 Wings et al.
2010/0086104 A1 4/2010 Michaelsen et al.

OTHER PUBLICATIONS

"Super Speed Solutions" Company leaflet, Bruker AXS, Karlsruhe, (2003).

Schuster, M. et al., "Parallel-Beam coupling into channel-cut monochromators using curved graded multilayers", Journal of Physics D. Applied Physics, 10P Publishing, Bristol, GB, vol. 28, No. 4A, Apr. 14, 1995, pa. A270-A275.

* cited by examiner

*Primary Examiner* — Courtney Thomas
(74) *Attorney, Agent, or Firm* — Paul Vincent

(57) ABSTRACT

An X-ray optical configuration for irradiation of a sample (1) with an X-ray beam having a line-shaped cross-section, wherein the configuration contains an X-ray source (2) and a beam-conditioning X-ray optics, is characterized in that the X-ray source (2) comprises a brilliant point source (4) and the X-ray optics comprises an X-ray optical element (3) which conditions X-ray light emitted by the point source in such a fashion that the X-ray beam is rendered parallel in one direction perpendicular to the beam propagation direction and remains divergent in a direction which is perpendicular thereto and also to the beam propagation direction. An X-ray optical element of this type enables use of both point-shaped and line-shaped beam geometries without complicated and time-consuming conversion work.

12 Claims, 4 Drawing Sheets

POINT-LINE CONVERTER

This application claims Paris Convention priority of DE 10 2010 062 472.1 filed Dec. 6, 2010 the complete disclosure of which is hereby incorporated by reference.

BACKGROUND OF THE INVENTION

The invention concerns an X-ray optical configuration for irradiation of a sample with an X-ray beam having a line-shaped cross-section, wherein the configuration contains an X-ray source and a beam-conditioning X-ray optics.

A configuration of this type is disclosed e.g. in the leaflet by Bruker AXS "Super Speed Solutions" (2003 Bruker AXS, Karlsruhe).

In X-ray diffractometry (XRD), interferences (reflexes) are generated on three-dimensional periodic structures on an atomic scale (crystals) in accordance with Bragg's Law. The angular position of the reflexes and the intensity thereof contain important information about the atomic structure and microstructure of the substances to be examined.

Point sources are used in X-ray diffractometry for examining point-shaped objects, e.g. small crystals with an edge length of 10 to 100 micrometers, or for measurements with a position resolution of down to a few 10 square micrometers on relatively large sample surfaces such as semiconductor wafers.

Line sources, however, are used for examining relatively large sample surfaces. This is typical for the use of the Bragg-Brentano geometry for determining crystalline phases in a sample and also for high-resolution diffractometry and high-resolution reflectometry. The use of line sources usually has two advantages: firstly, the electrons from the cathode and therefore the current are distributed over a larger surface of the anode (e.g. $0.4\times12$ mm$^2$ with a long fine focus tube). In this fashion, it is possible to typically operate at very high power, while preventing the anode from melting due to the heat load. The second advantage results from the fact that, with commercial metal ceramic tubes, the X-ray beam is normally extracted from the anode at an angle which is approximately 6°. For this reason, the visible focal spot is only $0.04\times12$ mm$^2$. The size of 0.04 mm has the effect that the angular resolution obtained in the diffraction experiment is much better compared to similar point sources.

The X-ray tube of a size of $0.4\times12$ mm$^2$ has a second X-ray permeable window at 90° relative to the line focus window. At an extraction angle of 6°, the focal spot has a size of $0.4\times1.2$ mm$^2$. The X-ray beam flux has exactly the same magnitude as through the window for the line focus but the angular resolution of the experiment is considerably worse due to the larger extension of the focal spot in the x-direction.

However, there are also diffraction experiments such as e.g. texture or internal stress, in which cases the angular resolution is not decisive.

Point sources that provide a resolution that is comparable to line sources should therefore have a focal spot of approximately $0.04\times0.04$ mm$^2$. These are microfocus sources which function, however, only at 50 W since the surface load with electrons would otherwise cause the anode to melt.

With a line focus, a larger amount of sample material additionally contributes to scattering in consequence of which a larger amount of the radiation is generated and the signal becomes larger, which again reduces the measuring time and/or improves the signal-to-noise ratio.

In order to be able to perform the whole range of measuring methods of thin layers, microstructures and nanostructures by means of X-ray diffractometry, the commercially available X-ray diffractometers must be converted between line focus and point focus sources. This conversion is extremely complex and time-consuming, since either the X-ray tube of glass ceramic tubes must be rotated, or the cathode, filament and direction of installation of rotating anodes must be changed. In correspondence therewith, the associated optics must be changed and readjusted, which is in most cases also complex. This obstructs, in particular, the use of microfocus sources or other brilliant X-ray sources.

The present invention enables the use of both point-shaped and line-shaped beam geometries without complicated and time-consuming conversion work.

SUMMARY OF THE INVENTION

This object is achieved by the invention in a surprisingly simple and effective fashion in that the X-ray source is a brilliant point source and the X-ray optics comprises an X-ray optical element which conditions X-ray light emitted by the point source in such a fashion that the X-ray is rendered parallel with respect to one direction perpendicular to the beam propagation direction and remains divergent with respect to a direction which is perpendicular thereto and also to the beam propagation direction.

In one particularly preferred embodiment, the aspect ratio $A_Q$ of the point source is $1\leq A_Q\leq1.5$ and the aspect ratio $A_S$ of the beam cross-section in the area of the sample is $A_S\geq2$.

One advantageous embodiment is characterized in that the X-ray optical element comprises a Kirkpatrick-Baez mirror system.

In one alternative embodiment variant, the X-ray optical element comprises a Montel mirror system.

In another preferred embodiment, the X-ray optical element can be rotated about the axis of the beam propagation direction, in particular through 90°.

Another embodiment is characterized in that the brilliant point source comprises a rotating anode and a microfocus source or a liquid metal configuration.

In another advantageous embodiment, a collimator is arranged in the area of the sample for collimating down the X-ray beam having a line-shaped cross-sectional profile to a beam profile with point-shaped beam cross-section.

Another advantageous embodiment is characterized in that the focussing X-ray optics consists of the X-ray optical element.

One alternative embodiment is to be preferred, in which a monochromator is arranged between the X-ray optical element and the sample.

The invention also comprises an X-ray optical element that is suited for use in an inventive X-ray optical configuration and is characterized in that the X-ray optical element can image a point on a line focus.

An X-ray analysis device comprising an inventive X-ray optical configuration is required for using the invention.

Further advantages of the invention can be extracted from the description and the drawing. The features mentioned above and below may be used individually or collectively in arbitrary combination. The embodiments illustrated and described are not to be understood as exhaustive enumeration but have exemplary character for describing the invention.

DESCRIPTION OF THE PREFERRED EMBODIMENT

Figure 1:
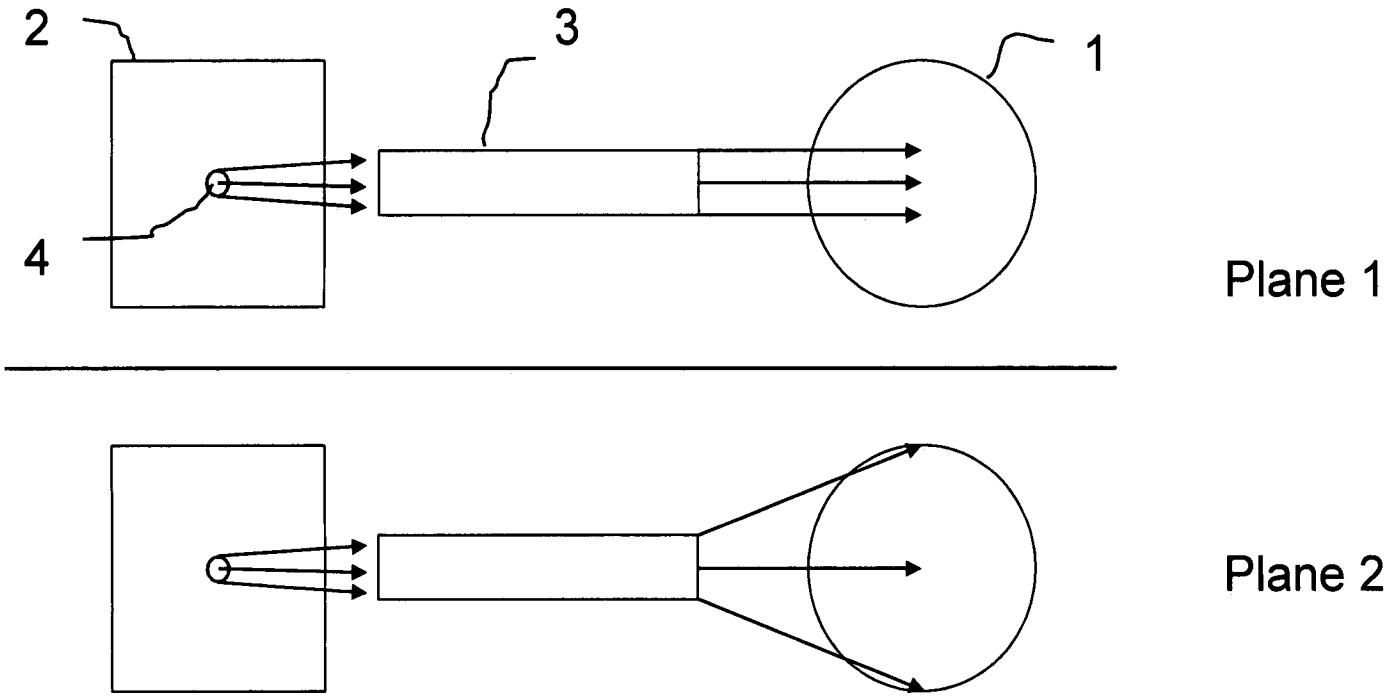
FIG. 1 shows a schematic sectional view in the longitudinal direction through the inventive device.

FIG. 1 schematically shows the inventive device. The illustration shows a sectional view in the longitudinal direction through the inventive device. The sample 1 is irradiated by X-ray radiation which propagates from the X-ray source 2 through the inventive X-ray optical element 3. The X-ray source 2 comprises a brilliant point source 4.

Figure 2:
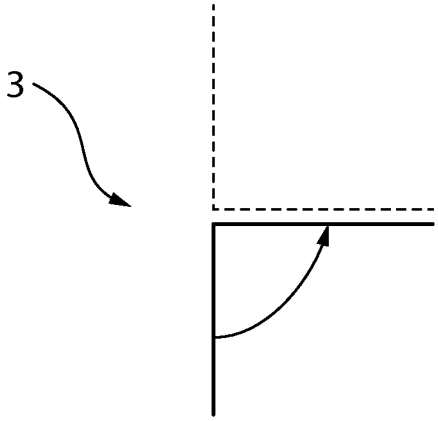
FIG. 2 schematically illustrates an X-ray optical element which is structured to rotate about an axis of a beam propagation direction.
Figure 3:
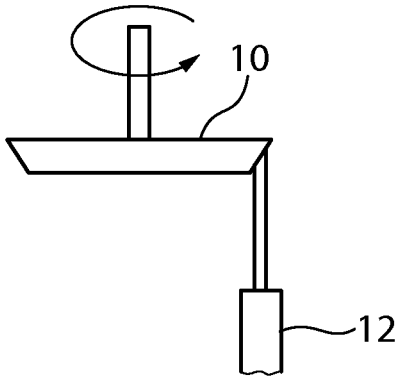
FIG. 3 illustrates a point source having a rotating anode and a microfocus source.
Figure 4:
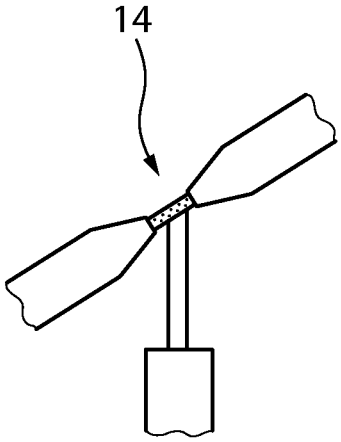
FIG. 4 shows a point source having a liquid metal configuration.
Figure 5:
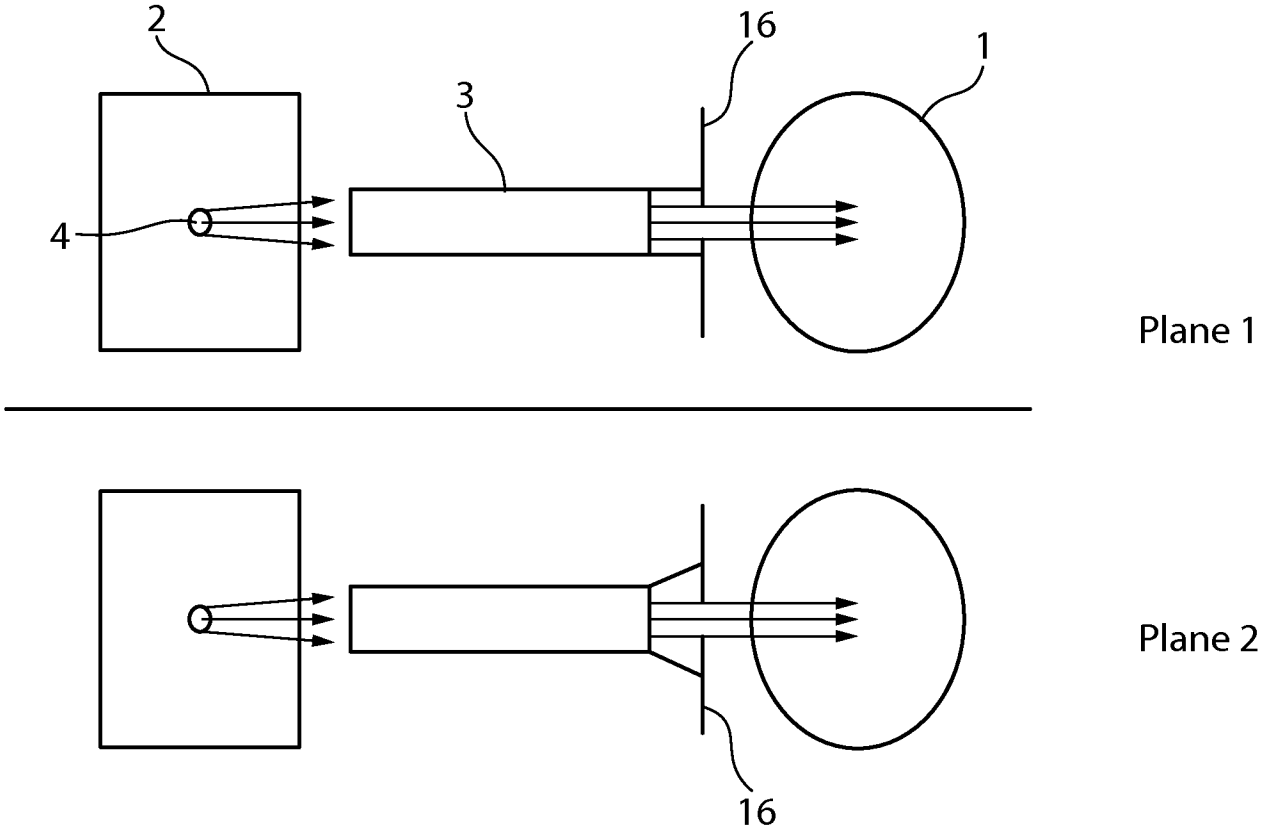
FIG. 5 shows a collimator disposed proximate to the sample.
Figure 6:
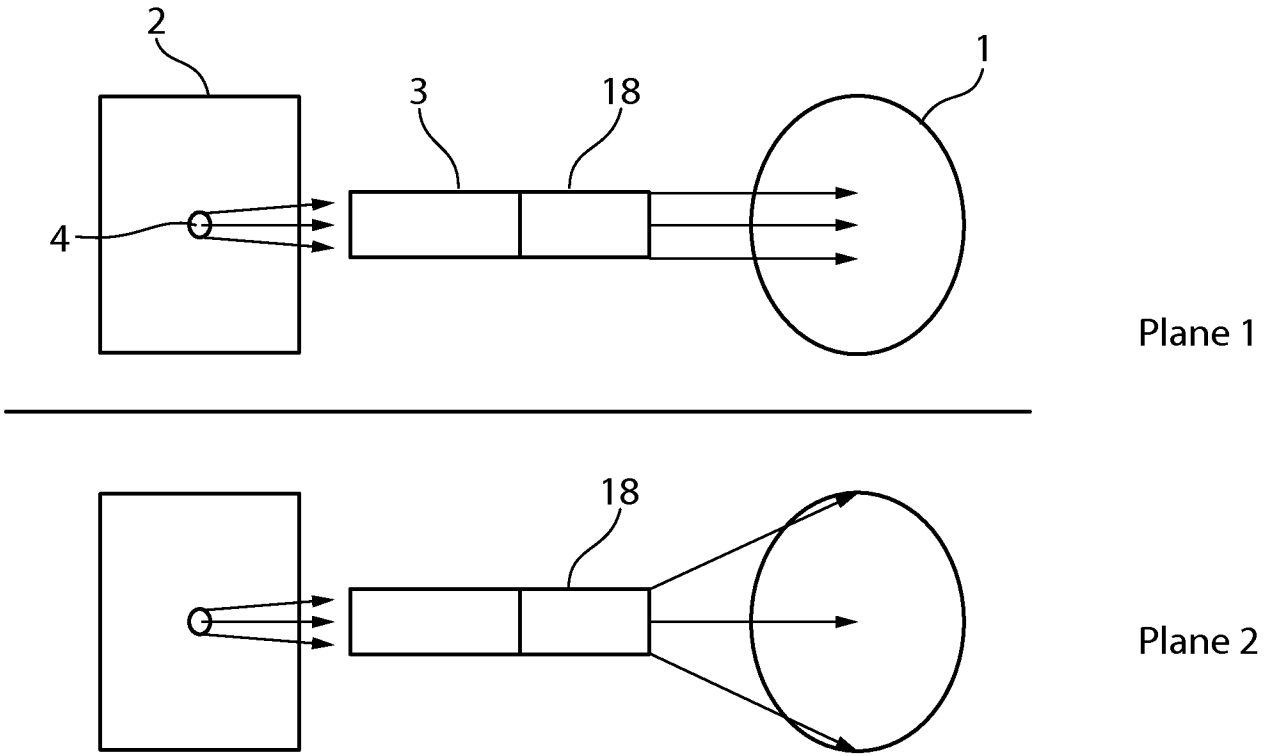
FIG. 6 illustrates a monochromator disposed between the X-ray optical element and the sample.

FIGS. 2 through 6 illustrate certain embodiments of the invention. The reference symbols correspond to those used in FIG. 1. FIGS. 5 and 6 correspond to FIG. 1 but with additional structural elements. FIG. 2 schematically illustrates an X-ray optical element 3 which is structured to rotate about an axis of a beam propagation direction through an angle of approximately 90 degrees. In FIG. 2, the beam is directed perpendicular to the plane of the drawing. The 90 degree rotation is schematically indicated by the presence of an arrow such that the X-ray optical element 3 can rotate from the position indicated by the solid lines into that indicated by the dashed lines in the figure. As schematically indicated in FIG. 3, the point source 4 can comprise an anode 10 and a microfocus source 12. The anode 10 is structured to rotate, as is schematically indicated by the arrow in FIG. 3. Alternately, as illustrated in FIG. 4, the point source 4 can comprise a liquid metal configuration 14. In accordance with the invention as illustrated in FIG. 5, a collimator 16 can be disposed in an area of the sample 1 for collimating down the X-ray beam from a line shape cross section profile to a beam profile having essentially a point shaped cross section. As indicated in FIG. 6, a monochromator 18 can be disposed between the x-ray optical element 3 and the sample 1.

LIST OF REFERENCE NUMERALS

1 sample
2 X-ray source
3 X-ray optical element
4 brilliant point source

We claim:

1. An X-ray optical configuration for irradiation of a sample, the configuration generating an X-ray beam having a line-shaped cross-section, the configuration comprising:

a brilliant X-ray point source; and a beam-conditioning X-ray optics, said X-ray optics comprising an X-ray optical element for conditioning X-ray radiation emitted by said point source in such a fashion that the X-ray beam is rendered parallel in a direction perpendicular to a beam propagation direction and remains divergent in a direction which is perpendicular thereto and also to the beam propagation direction.

2. The configuration of claim 1, wherein an aspect ratio $A_Q$ of said point source is $1 \leq A_Q \leq 1.5$ and an aspect ratio $A_S$ of a beam cross-section in an area of the sample is $A_S \geq 2$.

3. The configuration of claim 1, wherein said X-ray optical element comprises a Kirkpatrick-Baez mirror system.

4. The configuration of claim 1, wherein said X-ray optical element comprises a Montel mirror system.

5. The configuration of claim 1, wherein said X-ray optical element is structured to rotate about an axis of said beam propagation direction.

6. The configuration of claim 5, wherein said X-ray optical element can be rotated about the axis of said beam through 90°.

7. The configuration of claim 1, wherein said brilliant point source comprises a rotating anode and a microfocus source or a liquid metal configuration.

8. The configuration of claim 1, further comprising a collimator disposed in an area of the sample for collimating-down the X-ray beam, having a line-shaped cross-sectional profile, to a beam profile with point-shaped beam cross-section.

9. The configuration of claim 1, wherein focussing X-ray optics consists essentially of said X-ray optical element.

10. The configuration of claim 1, further comprising a monochromator disposed between said X-ray optical element and the sample.

11. An X-ray optical element structured for use in the X-ray optical configuration of claim 1, wherein the X-ray optical element is structured to image a point on a line focus.

12. An X-ray analysis device comprising the X-ray optical configuration of claim 1.

* * * * *